US009884229B2

(12) United States Patent
Kawakami et al.

(10) Patent No.: US 9,884,229 B2
(45) Date of Patent: Feb. 6, 2018

(54) TITANIUM ALLOY FOR GOLF CLUB FACE

(75) Inventors: Akira Kawakami, Tokyo (JP); Hideki Fujii, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 222 days.

(21) Appl. No.: 14/377,923

(22) PCT Filed: Feb. 24, 2012

(86) PCT No.: PCT/JP2012/054619

§ 371 (c)(1),
(2), (4) Date: Aug. 11, 2014

(87) PCT Pub. No.: WO2013/125038

PCT Pub. Date: Aug. 29, 2013

(65) Prior Publication Data

US 2015/0024871 A1 Jan. 22, 2015

(51) Int. Cl.

| | |
|---|---|
| ***C22C 14/00*** | (2006.01) |
| ***A63B 53/04*** | (2015.01) |
| ***C22F 1/18*** | (2006.01) |

(52) U.S. Cl.

CPC ..... *A63B 53/04* (2013.01); *A63B 53/047* (2013.01); *A63B 53/0466* (2013.01); *C22C 14/00* (2013.01); *C22F 1/183* (2013.01); *A63B 2053/0416* (2013.01); *A63B 2209/00* (2013.01)

(58) Field of Classification Search

CPC ... A63B 53/04; A63B 53/0466; A63B 53/047; A63B 2209/00; A63B 2053/0416; C22C 14/00; C22F 1/183

See application file for complete search history.

(56) References Cited

U.S. PATENT DOCUMENTS

| | | | |
|---|---|---|---|
| 2009/0180918 | A1 | 7/2009 | Tsai et al. |
| 2009/0181794 | A1 | 7/2009 | Tsai et al. |

FOREIGN PATENT DOCUMENTS

| | | | | |
|---|---|---|---|---|
| JP | 07-070676 | A | | 3/1995 |
| JP | 08-073968 | A | | 3/1996 |
| JP | 11036029 | A | * | 2/1999 |
| JP | 11-335758 | A | | 12/1999 |
| JP | 2004-010963 | A | | 1/2004 |
| JP | 2007-239030 | A | | 9/2007 |
| TW | 200839017 | A | | 10/2008 |
| TW | 200932920 | A | | 8/2009 |

OTHER PUBLICATIONS

Shimotori et al., English machine translation of JP 11-036029, Feb. 1999, p. 1-13.*

Andresen et al., "Effect of Microstructure", ASM Handbook, 1996, ASM International, p. 1-19.*

International Search Report issued in PCT/JP2012/054619 dated May 22, 2012.

* cited by examiner

*Primary Examiner* — Jessee Roe

(74) *Attorney, Agent, or Firm* — Birch, Stewart, Kolasch & Birch, LLP

(57) ABSTRACT

The present invention provides, as a material for a golf club face of a driver, an iron or the like, a titanium alloy which satisfies the regulation for a coefficient of restitution, and has high Young's modulus and tensile strength and also has excellent hot and cold workability. The titanium alloy for a golf club face according to the present invention comprises, in percent by mass, 1.0 to 3.5% of Al, 0.5 to 1.4% of Fe, 0.2 to 0.5% or O and 0.002 to 0.030% of N, and the balance of Ti with inevitable impurities, wherein an α-phase is strengthened by combined addition of O and Al, and inexpensive Fe is selected as a β-phase stabilizing element, leading to high strength and high Young's modulus in combination. The content of Al causing deterioration of hot workability is limited to a low value, leading to low rolling load during hot rolling, and thus flaws and edge cracking are unlikely to occur during hot rolling.

7 Claims, No Drawings

TITANIUM ALLOY FOR GOLF CLUB FACE

TECHNICAL FIELD

The present invention relates to a titanium alloy which is used as a material for a face of a golf club, mainly a driver.

BACKGROUND ART

In recent years, due to the introduction of regulations for a coefficient of restitution of (SLE rule) in which a golf club should not have any spring like effect (SLE), the types of titanium alloy materials used for golf club faces have changed significantly. Before the regulation for a coefficient of restitution was put into effect, β type titanium alloys having low Young's modulus and thus easily attaining high restitution performances, and also having high strength and excellent durability were mainly used. Of these β type titanium alloys, a Ti-15% V-3% Cr-3% Sn-3% Al alloy mainly referred to as a Ti-15-3 alloy, and alloys analogous thereto have mainly been employed since they also nave excellent workability. However, due to the introduction of the regulation for a coefficient of restitution, in order to satisfy the regulation by lowering a coefficient of restitution using the β type titanium alloy in which an increase in a coefficient of restitution is likely to be caused by low Young's modulus, there is nothing for it but to increase rigidity of a face surface by increasing a face sheet thickness. In this case, an increase in material cost is unavoidable in the case of making a trial of applying a β type titanium, alloy containing a large amount of expensive alloying elements such as V and Mo to a face material. Furthermore, in the case of using the β type titanium alloy as compared with the case of using a material, which has a Young's modulus higher than that of the β type titanium alloy and also has a specific strength equal to or higher than that of the β type titanium alloy, there is a need to increase the sheet thickness, so that the face of β type titanium alloy becomes heavy. Thus, it is difficult to increase the volume of a golf club head in which the β type titanium alloy is used for a face, leading to relatively small sweet spot when hitting a golf ball, thus causing a problem that it is difficult for users to use the club. For such a reason, the β type titanium alloy is not used mainly for a material for a golf club face any more.

On the contrary, an α+β type titanium alloy having a Young's modulus higher than that of the β type titanium alloy is becoming the mainstream as a material for a driver face. By use of the α+β type titanium alloy having a high Young's modulus, even if the face is made thin, the coefficient of restitution is less likely to increase, and thus the degree of freedom of sheet thickness, which meets the regulation for a coefficient of restitution, increases as compared with the case of using the β type titanium alloy. Due to having a specific gravity smaller than that of the β type titanium alloy, the α+β type titanium alloy can increase the volume of a club head even if it has the same mass as that of the β type titanium alloy. The α+β type titanium alloy also has a lot of merits such as low material cost because of lower contents of alloying elements which are expensive compared with the β type alloy. This α+β type titanium alloy is typically a Ti-6% Al-4% V. In addition to this, for example, Ti-5% Al-1% Fe, Ti-4.5% Al-3% V-2% Fe-2% Mo, Ti-4.5% Al-2% Mo-1.6% V-0.5% Fe-0.3% Si-0.03% C, Ti-6% Al-6% V-2% Sn, Ti-6% Al-2% Sn-4% Zr-6% Mo, Ti-8% Al-1% Mo-1% V, and Ti-6% Al-1% Fe alloys are used.

Use of these alloys enables satisfaction of the regulation for a coefficient of restitution even if the face is made thin as compared with the face made of the β type titanium alloy, and also control within an appropriate range of strength and ductility enables imparting durability required for a golf club face. In this case, it is desirable that a round bar product or the like capable of controlling restitution performances by changing a face shape and structure has a Young's modulus of 120 GPa or higher, a tensile strength of 800 MPa or higher, and a total elongation of 15% or higher. It is desirable that a thin sheet product with low degree of working during face forming has a Young's modulus of 135 GPa or higher, a tensile strength of 1000 MPa or higher, and a total elongation of 10% or higher in one direction in the sheet face. It is desirable that the Young's modulus satisfies the value mentioned above so as to meet the regulation for a coefficient of restitution, and the tensile strength and ductility satisfy the respective values mentioned above so as to obtain satisfactory durability. However, due to insufficient workability of these alloys, it was difficult to stably supply a material, which satisfies the regulation for restitution coefficient and is excellent in durability and is also capable of increasing the face volume with the reduction in thickness of the sheet, with high production yield at low production cost.

For example, a Ti-6% Al-4% V alloy as a most versatile α+β type alloy has sufficient strength and sufficient Young's modulus as a face material, and is already used largely as an alloy for a golf club face. However, this alloy had some problems, namely, it contains 6% of Al having solid, solution strengthening ability at high temperature and increasing deformation stress during hot rolling, and thus has unsatisfactory hot workability, and also contains 4% of V of an expensive β-phase stabilizing element, and thus results in comparatively high material cost.

Patent Literature 1 proposes an alloy having a high specific strength like a Ti-6% Al-4% V alloy and with low material cost. This is an α+β type alloy which aims at a high specific strength and low cost by replacing expensive elements having high specific gravities such as V and Mo, as β-phase stabilizing elements, by inexpensive Fe having high β-phase stabilizing ability, and adding a large amount of Al as an α-phase stabilizing element having a small specific gravity. However, this alloy has a problem that it is difficult to undergo hot working it because of a high Al content, of 5.5 to 7%. In particular, in order to reduce production cost of a face material, it is required to supply the material in the form of a sheet product which can be formed into a face shape only by light press forming and polishing processes. However, it is difficult to form the alloy material into a sheet product due to a high hot deformation stress thereof. In particular, this alloy has a problem that an appropriate hot rolling temperature thereof is in a narrow range and during hot rolling, significant, edge cracking occurs if the temperature becomes slightly lower than the range, thus leading to a significantly low production yield.

On the other hand, examples of an α+β type alloy with comparatively satisfactory workability include an alloy proposed in Patent Literature 2. This alloy is characterized by being capable of undergoing uni-directional cold rolling in the form of coil without problem. However, this alloy also has a problem such as limitation of hot working temperature since it contains 4.5% of Al which causes deterioration of hot workability, and a problem such as high material cost since it contains expensive β-phase stabilizing elements of Mo and V in amounts of 2.0% and 1.6%, respectively.

CITATION LIST

Patent Literature

PTL 1: JP 2004-10963 A
PTL 2: JP 11-335758 A

SUMMARY OF THE INVENTION

Problems to be Solved by the Invention Technical Problem

The present invention has been made in view of the above circumstances, and an object thereof is to provide an α+β type titanium alloy which is characterized by having a high Young's modulus and a high tensile strength, and also having excellent hot and cold workabilities.

Means to Solve the Problem

The present inventors have found that a titanium alloy having both high strength and high Young's modulus can be realized when an α-phase is strengthened by combined addition of O and Al, inexpensive Fe is selected as a β-phase stabilizing element, and the amounts of these alloying elements are optimized, to thereby reduce a β-phase fraction at room temperature. This alloy is a material which has a small specific gravity and is optimal for a golf club face material. Furthermore, since the content of Al, which causes deterioration of hot workability, in this alloy is limited to a low value as compared with those of the other α+β type alloys based mainly on Ti-6% Al-4% V alloy, a low rolling load is applied to the material during hot rolling, and thus flaw and edge cracking are unlikely to occur during hot rolling. Therefore, the alloy of the invention has an advantage that it can be satisfactorily used to manufacture products with any shape, including products in the form of sheet.

In other words, in order to solve the above problems, the gist, of the present invention resides in the following:

A titanium alloy for a golf club face, the alloy being excellent in hot and cold workabilities, wherein the alloy comprises, in percent by mass, 1.0 to 3.5% of Al, 0.5 to 1.4% of Fe, 0.20 to 0.50% of O and 0.002 to 0.030% of N, and the balance of Ti with inevitable impurities.

Effects of the Invention

According to the present invention, it is possible to provide an α+β type titanium alloy for a golf club face, which is characterized by having high strength/ductility balance and Young's modulus, and also has excellent hot and cold workabilities.

Embodiments to Carry Out the Invention

In a golf club face, high Young's modulus and high strength, are not always required in all directions and, particularly, high Young's modulus and high strength are required with respect to a longitudinal direction of the golf club face (the top-bottom direction of the club face immediately before the golf club face strikes a golf ball when a golfer hits the golf ball).

In order to solve the above problems, the present inventors have minutely examined an influence of component elements and a production method on material properties of a titanium alloy. As a result, it has been found that control of amounts of Fe, Al, O and N enables the production of an α+β type titanium alloy product which has excellent strength, ductility and Young's modulus for a golf club lace material, and is also excellent in hot and cold workability. When a sheet product is produced, uni-directional hot rolling or cold rolling causes significant texture development which causes material anisotropy, thus leading to occurrence of anisotropy in which the Young's modulus and strength in the sheet width direction perpendicular to the rolling direction increase as compared with those in the rolling direction. It has been found that the anisotropy is exhibited more significantly in the alloy of the present invention in which strengthening has been attained by both O and Al. Thus, the present, inventors have found that, when the longitudinal direction of the golf club face is taken to be the sheet width direction, high Young's modulus and high strength in longitudinal direction of the golf club face which is required for a golf club face is obtainable.

The present invention has been made based on the above findings. The reason why various elements to be contained are selected in the present invention, and the reason for the limitations of their content ranges will be shown below.

Fe is an inexpensive alloying element among β-phase stabilizing elements and has the function of strengthening the β-phase of a titanium alloy. Fe also has properties capable of stabilizing the β-phase even if the additive amount is comparatively small, because of high β-phase stabilizing ability. Strengthening required for a golf club face needs the addition of 0.5% or more of Fe. Meanwhile, Fe tends to be segregated during solidification of titanium alloys, and the addition of a large amount of Fe leads to an increase in volume fraction of the β-phase and deterioration of the Young's modulus, which leads to a round bar product of the titanium alloy exhibiting a Young's modulus of lower than 120 GPa, while a thin sheet product exhibiting a Young's modulus of lower than 135 GPa in one direction ox the sheet face, thus making it difficult to meet the regulation for a coefficient of restitution for a golf club face. Taking these influences thereof into consideration, the upper limit, of the amount of Fe added was set at 1.4%.

When attaching importance to the strength, the lower limit of Fe is desirably 0.7%. In order to surely suppress deterioration of the Young's modulus by attaching importance to more surely meet the regulation for a coefficient of restitution, the upper limit of Fe is desirably 1.2%.

Al is a titanium α-phase stabilizing element and has a high solid solution strengthening ability, and is also an inexpensive alloying element. In order to attain the strength level required for a golf club face in light of durability, namely, a tensile strength of 800 MPa or higher for a round bar product and a tensile strength of 1000 MPa or higher in one direction of the sheet face for a thin sheet product, by the below-mentioned combined addition of O and N, the lower limit of the additive amount was set at 1.0%. Meanwhile, the addition of more than 3.5% of Al causes deterioration of ductility due to excessive strengthening effect attained by the combined addition of Al with O, thus making it impossible to attain a total elongation of 10% or higher required for a golf club face in light of durability, and also causing deterioration of cold workability. Accordingly, there is a need to set the additive amount of Al at 3.5% or less.

When attaching more importance to the strength, the lower limit of Al is desirably 1.3%. When attaching importance to the durability, the upper limit of Al is desirably 3.2% so as to stably attain sufficient ductility.

O has the function of performing solid solution strengthening by being interstitially solid-soluted to the titanium α-phase. O also has an effect of strengthening the α-phase by the combined addition of O and Al, thus increasing the Young's modulus together with the strength. It is impossible to attain a strength which exhibits sufficient durability for a golf club face, namely, a tensile strength of 800 MPa or higher for a round bar product and a tensile strength of 1000 MPa or higher in one direction of the sheet for a thin sheet product, by the addition of less than 0.20% of O. Meanwhile, the addition of more than 0.50% of O causes deterioration of ductility due to an excessive strength, thus making it impossible to attain a total elongation of 10% or higher, and also causing deterioration of durability. Accordingly, the lower limit was set at 0.20%, while the upper limit was set at 0.50%.

Like O, N has a function of performing solid solution strengthening by being interstitially solid-soluted to the titanium α-phase. There is a need to add 0.002% or more of N so as to exert this effect. Meanwhile, when more than 0.030% of N is added by a conventional method of using sponge titanium containing a high concentration of N, undissolved inclusion called LDI (low density inclusion) is likely to be formed, leading to a low yield of the product. Accordingly, the lower limit was set at 0.002%, while the upper limit was set at 0.030%.

In the present invention, in the case of a titanium product, such as a round bar or thick plate, making it possible to limit a coefficient of restitution to a low level by being subjected to a comparatively severe forming process to thereby control the shape of face produced, it is possible to obtain a golf club face with satisfactory properties by satisfying the above-mentioned component ranges. In particular, when forming a face shape by hot forging or the like, the alloy of the present invention exhibits satisfactory workability, so that it is suitable as a face material.

Meanwhile, in the case of producing a thin sheet product, which will be subjected to merely a mild process for shaping a club face and has a small margin of attaining a low coefficient of restitution by the face shape, if a texture called transverse-texture is developed, a tensile strength and a Young's modulus in the sheet width direction of the titanium alloy of the invention increase, so that the titanium alloy of the present invention is preferable as a material for a golf club face. In this case, when the titanium alloy, in which Al, Fe and O are limited to the above-mentioned ranges, is heated to the temperature of a single β phase area, or the temperature of a α+β dual-phase area just below the β transus and is then uni-directionally hot-rolled, or further annealed under appropriate conditions after uni-directional cold rolling in the same direction as the hot rolling direction, the transverse-texture is likely to be developed, leading to an increase in strength and Young's modulus in the sheet width direction. In this way, it is possible to produce a material which is optimal for a material for a club face.

When this thin sheet material is produced, the titanium alloy is consistently rolled only in one direction from the beginning to the completion of the hot or cold rolling, for the purpose of efficiently obtaining the transverse-texture which enables a high Young's modulus in the sheet width direction associated with material anisotropy, which is a target of the present invention. Thus, it becomes possible to produce a club face, which copes with the regulation for restitution coefficient and is excellent in durability, by arranging a titanium alloy thin sheet having high Young's modulus and strength/ductility balance according to the present invention such that the sheet width direction of the titanium alloy thin sheet aligns with the longitudinal direction of a golf club face or a direction close thereto.

EXAMPLES

Example 1

Using a vacuum arc melting method, titanium materials having chemical compositions and β transus shown in Table 1 were melted and then subjected to hot forging to give billets having a diameter of 100 mm. The billets were heated to 950° C. and then hot-rolled to produce round bars having a diameter of 18 mm. A surface flaw depth of the hot-rolled round bar was measured, by a depth gauge, and a hot workability was evaluated in a three-level fashion (A: maximum flaw depth ≤0.3 mm, B: maximum flaw depth, of more than 0.3 mm and less than 0.5 mm, C: maximum flaw depth ≥0.5 mm). When the flaw depth is 0.3 mm or less, amount of machining at the subsequent peeling step can be decreased, leading to low working cost, and thus hot workability of the round bar can be rated "satisfactory". After annealing the round bars at 700° C. for 2 hours, JIS No. 14 tensile specimens having an average diameter of 6 mm were sampled and their tensile properties were examined. In order to attain satisfactory durability for a golf club face, a tensile strength (TS) of about 800 MPa or higher and a total elongation (EL) of 15% or higher are required. The results are collectively shown in Table 1.

TABLE 1

| Test | Content (% by mass) | | | | | | | 0.2% PS | Young's modulus | TS | EL | RA | Level of hot rolling | |
|---|---|---|---|---|---|---|---|---|---|---|---|---|---|---|
| number | Al | Fe | V | O | N | Ti | β transus (° C.) | (MPa) | (GPa) | (MPa) | (%) | (%) | flaw | Remarks |
| 1 | 6.1 | — | 3.9 | 0.16 | 0.011 | bal. | 1,006 | 788 | 115 | 874 | 18 | 38 | C | Comparative Example |
| 2 | 7.2 | 1.0 | — | 0.15 | 0.023 | bal. | 1,048 | 837 | 117 | 927 | 19 | 36 | C | Comparative Example |
| 3 | 0.7 | 0.9 | — | 0.32 | 0.012 | bal. | 934 | 686 | 113 | 788 | 22 | 51 | A | Comparative Example |
| 4 | 1.3 | 0.9 | — | 0.32 | 0.012 | bal. | 946 | 713 | 121 | 817 | 21 | 44 | A | Present invention |
| 5 | 1.9 | 0.9 | — | 0.32 | 0.012 | bal. | 959 | 744 | 122 | 845 | 20 | 42 | A | Present invention |
| 6 | 2.6 | 0.9 | — | 0.32 | 0.011 | bal. | 974 | 799 | 124 | 882 | 18 | 40 | A | Present invention |
| 7 | 3.9 | 0.9 | — | 0.32 | 0.011 | bal. | 1,000 | 891 | 132 | 968 | 14 | 36 | B | Comparative Example |

TABLE 1-continued

| Test number | Content (% by mass) Al | Fe | V | O | N | Ti | β transus (° C.) | 0.2% PS (MPa) | Young's modulus (GPa) | TS (MPa) | EL (%) | RA (%) | Level of hot rolling flaw | Remarks |
|---|---|---|---|---|---|---|---|---|---|---|---|---|---|---|
| 8 | 1.8 | 0.2 | — | 0.35 | 0.022 | bal. | 975 | 691 | 111 | 792 | 22 | 50 | A | Comparative Example |
| 9 | 1.8 | 0.7 | — | 0.35 | 0.022 | bal. | 965 | 743 | 121 | 847 | 20 | 41 | A | Present invention |
| 10 | 1.8 | 1.2 | — | 0.36 | 0.022 | bal. | 956 | 785 | 122 | 876 | 19 | 40 | A | Present invention |
| 11 | 1.8 | 1.9 | — | 0.36 | 0.022 | bal. | 943 | 893 | 132 | 977 | 14 | 35 | A | Comparative Example |
| 12 | 2.7 | 1.1 | — | 0.15 | 0.006 | bal. | 950 | 678 | 110 | 787 | 20 | 42 | A | Comparative Example |
| 13 | 2.7 | 1.1 | — | 0.24 | 0.006 | bal. | 961 | 780 | 121 | 873 | 21 | 40 | A | Present invention |
| 14 | 2.7 | 1.1 | — | 0.41 | 0.006 | bal. | 982 | 911 | 134 | 997 | 17 | 38 | A | Present invention |
| 15 | 2.7 | 1.1 | — | 0.54 | 0.006 | bal. | 997 | 1,013 | 145 | 1,088 | 14 | 34 | A | Comparative Example |
| 16 | 2.2 | 0.8 | — | 0.29 | 0.0005 | bal. | 962 | 678 | 110 | 791 | 21 | 47 | A | Comparative Example |
| 17 | 2.2 | 0.8 | — | 0.29 | 0.018 | bal. | 965 | 733 | 122 | 835 | 18 | 40 | A | Present invention |
| 18 | 2.2 | 0.8 | — | 0.29 | 0.041 | bal. | 968 | 776 | 120 | 843 | 11 | 29 | C | Comparative Example |
| 19 | 2.0 | 1.2 | — | 0.44 | 0.015 | bal. | 971 | 878 | 131 | 957 | 16 | 39 | A | Present invention |
| 20 | 3.2 | 0.7 | — | 0.25 | 0.005 | bal. | 980 | 746 | 121 | 832 | 22 | 43 | A | Present invention |

A: Maximum flaw depth ≤ 0.3 mm
B: Maximum flaw depth of more than 0.3 mm and less than 0.5 mm
C: Maximum flaw depth ≥ 0.5 mm In Table 1, test numbers 1 and 2 respectively show the results of a Ti-6% Al-4% V alloy and a Ti-7% Al-1% Fe alloy. In both test numbers 1 and 2, while the tensile strengths are higher than the target value of 800 MPa, hot rolling flaws having a depth of 0.5 mm or more occur, and thus hot workability of these alloys is poor.

To the contrary, in test numbers 4, 5, 6, 9, 10, 13, 14, 17, 19, and 20 as examples of the present invention, high tensile strengths of 800 MPa or more and high total elongations of higher than 15% are attained, and hot rolling flaws having a depth of more than 0.3 mm do not occur, and thus not workability is satisfactory. All examples of the present invention ensured a Young's modulus of 120 GPa or higher.

On the other hand, in test numbers 3, 8, 12, and 16, sufficient strengths for club face materials are not attained since the tensile strengths are less than 800 MPa. This is because the amount of Al added in test number 3, the amount of Fe added in test, number 8, the amount of O added in test number 12, and the amount, of N added in test, number 16 were smaller than the respective lower limits of the invention, and thus the tensile strengths thereof decreased because of insufficient solid solution strengthening.

In test numbers 7, 11, 15, and 18, sufficient ductility is not attained since the total elongations are less than 15%, thus making it impossible to impart high durability. This is because since the amount of Al added in test number 7, the amount of Fe added in test number 11, and the amount of O added in test number 15 were more than the upper limits of the present invention, the strengths thereof excessively increased, thus causing deterioration of ductility. In test, number 18, since N was added in the amount which is more than the upper limit of the present invention, LDI occurred, thus causing deterioration of ductility.

In test numbers 7 and 18, numerous surface defects having depths of more than 0.3 mm and 0.3 mm, respectively, occurred after hot rolling. This is because in test number 7, Al, which causes deterioration of hot workability, was added in the amount which is more than the upper limit of the present invention, and thus hot rolling flaws occurred. In test number 18, LDIs occurred due to excess N content and those in the vicinity of the surface were recognized as defects, leading to the low evaluation level of hot rolling flaw.

As is apparent from the above results, the titanium alloys having the contents of alloying elements defined in the present invention have high tensile strengths, high Young's moduli and high total elongations, and have excellent material properties as a material for a golf club face, and also have satisfactory hot workability. Meanwhile, when the chemical compositions deviate from the amounts of alloying elements defined in the present invention, hot workability deteriorates and it is impossible to satisfy requisite material properties such as tensile strength and ductility.

Example 2

Using a vacuum arc melting method, titanium materials having chemical compositions and β transus shown in test numbers 5, 10, and 14 of Table 1 were melted and then hot-forged to give slabs having a thickness of 180 mm. The slabs were uni-directionally hot-rolled under the conditions shown in Tables 2 to 4 to produce hot-rolled sheets having a thickness of 4 mm. After a shot blast treatment, oxide scales were removed by pickling the hot-rolled sheet, during which a surface flaw depth was measured by a depth gauge, and a hot workability was evaluated in a three-level fashion (A: maximum flaw depth ≤0.2 mm, B: maximum flaw depth is more than 0.2 mm and less than 0.5 map C: maximum, flaw depth ≥0.5 mm). The results thus obtained and the examination results of tensile properties are collectively shown in Tables 2 to 4.

TABLE 2

| Test number 5 of Table 1 | | | | | | | |
|---|---|---|---|---|---|---|---|
| Test number | Hot rolling heating temperature (° C.) | Tensile strength in sheet width direction (MPa) | Young's modulus in sheet width direction (GPa) | Total elongation in sheet width direction (%) | Tensile strength in sheet longitudinal direction (MPa) | Young's modulus in sheet longitudinal direction (GPa) | Level of hot rolling flaw |
| 21 | 975 | 1,052 | 145 | 12 | 866 | 112 | A |
| 22 | 890 | 1,033 | 142 | 13 | 841 | 114 | A |
| 23 | 965 | 1,056 | 145 | 12 | 860 | 112 | A |
| 24 | 1,000 | 1,051 | 145 | 13 | 845 | 111 | A |
| 25 | 900 | 1,043 | 143 | 12 | 857 | 112 | A |

Level of hot rolling flaw
A: Maximum flaw depth ≤ 0.2 mm
B: Maximum flaw depth of more than 0.2 mm and less than 0.5 mm
C: Maximum flaw depth ≥ 0.5 mm

TABLE 3

| Test number 10 of Table 1 | | | | | | | |
|---|---|---|---|---|---|---|---|
| Test number | Hot rolling heating temperature (° C.) | Tensile strength in sheet width direction (MPa) | Young's modulus in sheet width direction (GPa) | Total elongation in sheet width direction (%) | Tensile strength in sheet longitudinal direction (MPa) | Young's modulus in sheet longitudinal direction (GPa) | Level of hot rolling flaw |
| 26 | 980 | 1,127 | 146 | 12 | 945 | 112 | A |
| 27 | 910 | 1,098 | 143 | 13 | 961 | 114 | A |
| 28 | 1,010 | 1,103 | 145 | 12 | 935 | 112 | A |
| 29 | 990 | 1,120 | 146 | 13 | 921 | 111 | A |
| 30 | 890 | 1,091 | 144 | 12 | 936 | 112 | A |

Level of hot rolling flaw
A: Maximum flaw depth ≤ 0.2 mm
B: Maximum flaw depth of more than 0.2 mm and less than 0.5 mm
C: Maximum flaw depth ≥ 0.5 mm

TABLE 4

| Test number 14 of Table 1 | | | | | | | |
|---|---|---|---|---|---|---|---|
| Test number | Hot rolling heating temperature (° C.) | Tensile strength in sheet width direction (MPa) | Young's modulus in sheet width direction (GPa) | Total elongation in sheet width direction (%) | Tensile strength in sheet longitudinal direction (MPa) | Young's modulus in sheet longitudinal direction (GPa) | Level of hot rolling flaw |
| 31 | 1,030 | 1,154 | 146 | 10 | 966 | 112 | A |
| 32 | 920 | 1,112 | 143 | 11 | 982 | 114 | A |
| 33 | 995 | 1,163 | 145 | 10 | 973 | 112 | A |
| 34 | 1,000 | 1,159 | 146 | 11 | 977 | 111 | A |
| 35 | 910 | 1,123 | 144 | 12 | 945 | 112 | A |

Level of hot rolling flaw
A: Maximum flaw depth ≤ 0.2 mm
B: Maximum flaw depth of more than 0.2 mm and less than 0.5 mm
C: Maximum flaw depth ≥ 0.5 mm Tables 2 to 4 respectively show the results in sheet products of the compositions shown in test numbers 5, 10, and 14. All sheets produced under the conditions of Tables 2 to 4 sufficiently satisfy a tensile strength in the sheet width direction of 1000 MPa or higher and a Young's modulus of 135 GPa or higher, which are required for a golf club face, and also ensures a total elongation of 10% or higher. Accordingly, the golf club faces produced by using these sheet materials have properties in compliance with the regulation for a coefficient of restitution and satisfactory durability in combination. Surface defects exceeding a depth of 0.2 mm do not occur in these hot rolled and pickled sheets, and thus these sheets exhibit satisfactory hot reliability. Accordingly, these thin sheet materials are suitable as materials for a golf club face.

In particular, in test numbers 21, 23, 24, 26, 28, 29, 31, 33, and 34, high Young's moduli of 145 GPa or higher are attained in the sheet width direction and, when a comparison is made between them and test numbers having the same chemical composition of alloy, the tensile strengths of the above test numbers are higher than those in test numbers 22, 25, 27, 30, 32, and 35, and the former have excellent performances with respect to the regulation for a coefficient, of restitution and also have satisfactory durability. This is because in test numbers 22, 25, 27, 30, 32, and 35, since the reheating temperatures prior to hot rolling were comparatively lower temperatures of the $\alpha+\beta$ dual-phase area, the transverse-textures were not sufficiently developed as compared with a case of heating to a temperature of a single $\beta$ phase area or a temperature of a $\alpha+\beta$ dual-phase area just below the $\beta$ transus, and thus in-plane anisotropy did not increase. To the contrary, in test numbers 21, 23, 24, 26, 28, 29, 31, 33, and 34, the transverse-textures were developed by heating to the single $\beta$ phase area followed by hot rolling, leading to increased material anisotropy in a sheet surface, thus providing high Young's moduli and high tensile strengths in the sheet width direction.

As is apparent from the above results, the titanium, alloys having the chemical compositions defined in the present invention have excellent properties as sheet materials for a golf club face. Therefore, it is possible to produce a sheet material for a golf club face, which has high Young's modulus, high tensile strength and high ductility in the sheet width direction, by uni-directionally hot-rolling a titanium alloy containing the alloying elements within the component ranges defined in the present invention.

INDUSTRIAL APPLICABILITY

Using titanium alloy of the present invention, a round bar product having a Young's modulus of 120 GPa or higher, a tensile strength of 800 MPa or higher and a total elongation of 15% or higher can be obtained, and a thin sheet product having a Young's modulus of 135 GPa or higher, a tensile strength of 1000 MPa or higher and a total elongation of 10% or more in one direction of the sheet can be obtained. As a result, it is possible to provide a material which satisfies the regulation for a coefficient of restitution and has excellent durability when formed into a golf club face, and therefore is suitable for golf club face applications.

The invention claimed is:

1. A sheet material of a titanium alloy for a golf club face, wherein the alloy consists of, in percent by mass, 1.0 to 3.5% of Al, 0.5 to 1.4% of Fe, 0.20 to 0.50% of O and 0.002 to 0.030% of N, with a balance of Ti and inevitable impurities, and wherein the sheet material has material anisotropy.

2. The sheet material as claimed in claim 1, wherein the sheet material has a tensile strength of 1000 MPa or higher and a Young's modulus of 135 GPa or higher in a sheet width direction.

3. The sheet material as claimed in claim 2, wherein a ratio of a tensile strength in a sheet longitudinal direction to a tensile strength in a sheet width direction is 88.3% or less, and ratio of a Young's modulus in a sheet longitudinal direction to a Young's modulus in a sheet width direction of 80.3% or less.

4. The sheet material as claimed in claim 3, wherein the ratio of the tensile strength in a sheet longitudinal direction to the tensile strength in a sheet width direction is 84.8% or less, and the ratio of the Young's modulus in a sheet longitudinal direction to the Young's modulus in a sheet width direction is 77.2% or less.

5. The sheet material as claimed in claim 1, wherein the sheet material is a hot-rolled sheet material.

6. A round bar of a titanium alloy for a golf club face, wherein the alloy consists of, in percent by mass, 1.0 to 3.5% of Al, 0.5 to 1.4% of Fe, 0.20 to 0.50% of O and 0.002 to 0.030% of N, with a balance of Ti and inevitable impurities, and wherein the round bar has material anisotropy.

7. The round bar as claimed in claim 6, wherein the round bar is a hot-rolled round bar.

* * * * *